US008555450B1

(12) United States Patent
Sabol et al.

(10) Patent No.: US 8,555,450 B1
(45) Date of Patent: Oct. 15, 2013

(54) RESIDENTIAL WOOD FLOOR CLEANING MACHINE

(75) Inventors: Christine A. Sabol, Limerick, PA (US); Eugene C. Bowman, Royersford, PA (US)

(73) Assignee: Christine A. Sabol, Limerick, PA (US)

( * ) Notice: Subject to any disclaimer, the term of this patent is extended or adjusted under 35 U.S.C. 154(b) by 0 days.

(21) Appl. No.: 13/483,797

(22) Filed: May 30, 2012

(51) Int. Cl.
*A47L 11/40* (2006.01)

(52) U.S. Cl.
USPC ..... 15/98; 15/49.1; 15/50.1

(58) Field of Classification Search
USPC ..... 15/98, 49.1, 50.1, 52
See application file for complete search history.

(56) References Cited

U.S. PATENT DOCUMENTS

| | | | | |
|---|---|---|---|---|
| RE19,290 | E | 8/1934 | Goosman | |
| 2,782,452 | A | 2/1957 | Kitto et al. | |
| 4,432,472 | A | 2/1984 | Lamm | 222/174 |
| 4,524,477 | A | 6/1985 | Williams, III et al. | 15/50 |
| 4,633,541 | A * | 1/1987 | Block | 15/49.1 |
| 5,355,542 | A | 10/1994 | Oreck et al. | 15/49.1 |
| 5,371,912 | A | 12/1994 | Hall | 15/98 |
| 5,390,388 | A | 2/1995 | Cutler | 15/98 |
| 5,797,157 | A | 8/1998 | Gregg | 15/49 |
| 5,888,006 | A | 3/1999 | Ping et al. | 401/137 |
| 6,493,896 | B1 * | 12/2002 | Stuchlik et al. | 15/49.1 |
| 6,571,415 | B2 * | 6/2003 | Gerber et al. | 15/98 |
| 6,763,544 | B2 * | 7/2004 | Stuchlik | 15/50.1 |
| D497,697 | S | 10/2004 | Alsruhe et al. | 32/25 |
| D498,027 | S | 11/2004 | Alsruh et al. | D32/19 |
| 6,871,372 | B2 | 3/2005 | Vosbikian et al. | 15/115 |
| RE39,581 | E * | 4/2007 | Stuchlik et al. | 15/49.1 |
| 7,331,355 | B2 | 2/2008 | Barnabas et al. | 134/25.2 |
| 7,530,135 | B2 * | 5/2009 | Benedict | 15/50.1 |
| 7,533,435 | B2 * | 5/2009 | Pedlar et al. | 15/49.1 |
| 7,827,645 | B2 * | 11/2010 | Eklund et al. | 15/50.1 |
| 8,047,736 | B2 * | 11/2011 | Jordan | 401/284 |
| 8,171,592 | B2 * | 5/2012 | Tsai | 15/98 |
| 8,245,345 | B2 * | 8/2012 | Pedlar et al. | 15/49.1 |
| 8,356,375 | B2 * | 1/2013 | Geurkink | 15/50.1 |
| 2002/0073494 | A1 * | 6/2002 | Stuchlik | 15/49.1 |
| 2003/0019071 | A1 * | 1/2003 | Field et al. | 15/320 |
| 2004/0045108 | A1 * | 3/2004 | Fellhauer | 15/49.1 |
| 2005/0183222 | A1 | 8/2005 | Grohe, Jr. | 15/49.1 |
| 2005/0235444 | A1 * | 10/2005 | Gerber et al. | 15/98 |
| 2005/0241086 | A1 * | 11/2005 | Damrath et al. | 15/98 |
| 2005/0246845 | A1 * | 11/2005 | Duncan et al. | 15/49.1 |
| 2005/0251937 | A1 * | 11/2005 | Ruffo | 15/49.1 |
| 2006/0254008 | A1 * | 11/2006 | Hahn et al. | 15/50.3 |
| 2007/0192973 | A1 * | 8/2007 | Eklund et al. | 15/50.1 |

(Continued)

*Primary Examiner* — Monica Carter
*Assistant Examiner* — Michael Jennings
(74) *Attorney, Agent, or Firm* — Michael F. Petock, Esq; Douglas J. Petock; Petock & Petock, LLC

(57) ABSTRACT

A residential wood floor cleaning machine provides an easily attachable and removable cleaning cloth to a rotating orbiting head mounted in a lightweight structure for use in cleaning wood floors in residences. The cleaning machine includes LED's for illuminating an area of the wood floor adjacent to the head. A mechanical spray pump with a removable reservoir controllably sprays a controlled amount of cleaning solution on the illuminated area. An electrical control requires that the light is on whenever the power is on. A mechanical sprayer operating means is mounted within a tubular structure which supports the sprayer. The tubular structure is preferably interconnected with a pivoting handle with a truss like structure which reduces the overall weight of the machine. The handle bracket is provided with a stop to prevent pivoting by more than 90 degrees.

11 Claims, 3 Drawing Sheets

(56) References Cited

U.S. PATENT DOCUMENTS

2007/0214586 A1* 9/2007 Mattucci et al. ..... 15/4
2008/0145132 A1* 6/2008 Sandoval ..... 401/9
2008/0201877 A1* 8/2008 Sengewald et al. ..... 15/4
2008/0268758 A1* 10/2008 Liffers et al. ..... 451/353
2010/0319147 A1* 12/2010 Geurkink ..... 15/49.1
2011/0047730 A1* 3/2011 Krausnick et al. ..... 15/49.1

* cited by examiner

RESIDENTIAL WOOD FLOOR CLEANING MACHINE

FIELD OF THE INVENTION

The present invention relates to a residential wood floor cleaning machine. More particularly, the present invention relates to a light weight cleaning machine which may be used for the cleaning of residential wood floors providing sufficient rubbing action on the floor after a controllable light spray is provided to the floor in a well lighted area.

BACKGROUND OF THE INVENTION

There appears to be little on the market in the way of effective and efficient cleaning of wood floors in the home. To provide effective cleaning of residential wood floors, a person must get down on the floor on his or her hands and knees with a cloth providing sufficient rubbing force using his or her hands and arms after application of a wood cleaning floor solution.

There is also a problem if too much solution is applied to the floor as this is typically an aqueous base which is not particularly good for wood floors when applied in excess. Large rotating floor buffers used in commercial applications, are not particularly good for cleaning residential wood floors. These are too heavy, bulky and dangerous for use by a typical housewife.

SUMMARY OF THE INVENTION

The present invention provides an efficient and effective means for cleaning wood floors in a residential setting.

Another advantage of the present invention is that it provides a cleaning machine which is lightweight and easy to handle.

Another advantage of the present invention is that the cleaning surface may be an economical terry cloth material from various sources.

Another advantage of the present invention is that the present invention provides a cleaning head which not only rotates but provides an orbital circular motion.

Another advantage of the present invention is that the area to be cleaned is well illuminated both before cleaning, during a spraying operation and to monitor the results of the cleaning operation.

Another advantage of the present invention is that the handle pivots, but is precluded from pivoting by more than about 90 degrees.

Another advantage of the present invention is that a sprayer used to spray a cleaning solution on the floor is controllable in a manner similar to a mechanical hand sprayer, thereby not resulting in excess fluid being sprayed on the floor.

Another advantage of the present invention is that the sprayer has a removable reservoir which provides ease of refilling of the sprayer.

Another advantage of the present invention is that the terry cloth cleaning surface may be applied to the head by simple and inexpensive means of a rubber band or by the simple manner of mounting hook type cloth fasteners to the bottom of the cleaning head.

Another advantage of the present invention is that the walls are protected by a ring mounted to the housing of the cleaning head and that the handle brackets are mounted within this ring.

Another advantage of the present invention is that is utilizes one or more LED lights which provide bright and effective lighting.

Another advantage of the present invention is that the handle and sprayer mount structure may be made lighter weight material by utilizing a truss like structure between the handle of the machine and a sprayer tube mounting and operating structure.

Another advantage of the present invention is that the sprayer is mounted, when the handle is positioned at an operating angle, directly over the area illuminated by the LED lights.

Another advantage of the present invention is that the light is on whenever the motor is operating.

Briefly and basically, in accordance with the present invention there is provided an orbital circular cleaning head mounted in a circular housing and driven by an electric motor. Means are provided for attaching a cleaning cloth, such as a terry cloth, to the head. A handle is mounted to a bracket with the bracket being pivotally mounted to the housing and contained within the diameter of the housing. The bracket includes a stop for preventing the handle and bracket from pivoting more than about 90 degrees. At least one light emitting diode (LED) light is mounted to direct LED light to eliminate a portion of floor area adjacent to the cleaning head. A tubular structure is mounted to the handle. A sprayer is mounted to a lower portion of the tubular structure for controllably spraying a controlled amount of liquid on the floor area illuminated by the LED light. A mechanical operating means mounted within the tubular structure is operable by a first lever mounted on an upper portion of the handle to controllably spray in response to the mechanical operating means being operated by the first lever. The sprayer is provided with a removable reservoir for ease in refilling it with wood floor cleaning solution. Electrical controls are provided including an on/off switch mounted on an upper portion of the handle for supplying power to said at least one LED light and to an operating switch, and a second lever for operating said operating switch to turn on and off the electrical power to operate the electrical motor.

In a presently preferred embodiments, the terry cloth may be attached to the head by means of a rubber band mounted over the terry cloth over a groove in a periphery of the head. Alternatively, the terry cloth may be attached to the head by mounting hook type cloth fasteners to the bottom of the head which engages loops of the terry cloth.

Preferably, the LED lighting provides intense lighting of the area which is to be cleaned, the area to be sprayed and to observe the area after cleaning. It is presently preferred that four LED lights be used to provide the intense lighting, but this may be accomplished by less or more LED lights.

In accordance with one of the presently preferred embodiments of the invention, the bracket on the lower end of the handle is pivotally mounted to a ring of the housing on the periphery of the housing. Further it is preferably mounted such that the bracket is inside of the ring and the bracket is provided with a stop to prevent the handle from pivoting by more than about 90 degrees.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

DETAILED DESCRIPTION OF THE PREFERRED EMBODIMENTS

Figure 1:
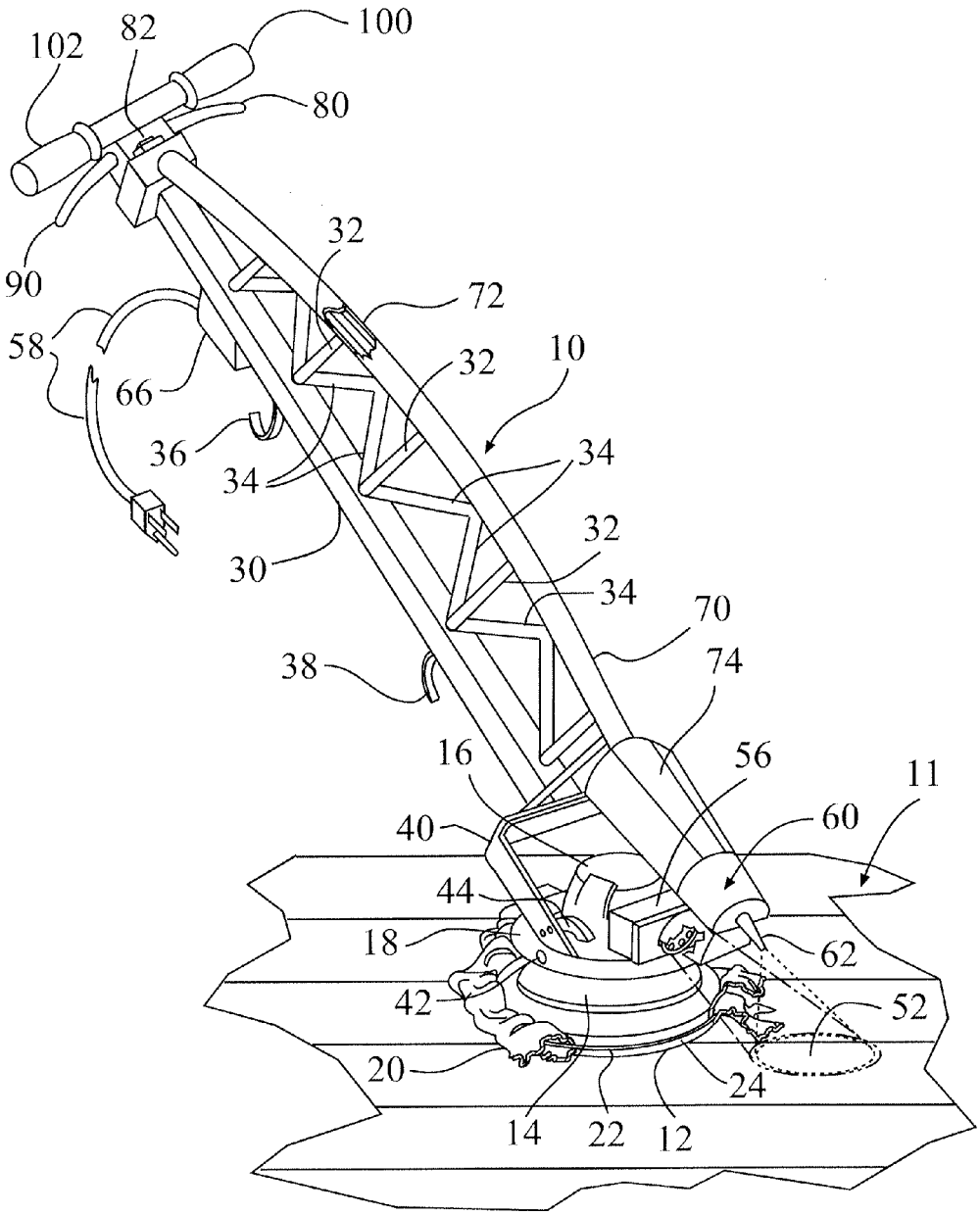
FIG. 1 is a view in perspective of a residential wood floor cleaning machine in accordance with the present invention.

Referring now to the drawings in detail, wherein like numerals indicate like elements, there is shown in FIG. 1 a residential wood floor cleaning machine 10 for cleaning a wood floor 11 in accordance with the present invention. Cleaning machine 10 includes an orbital circular cleaning head 12 which is mounted in a circular housing 14 and driven by an electric motor 16.

Figure 4:
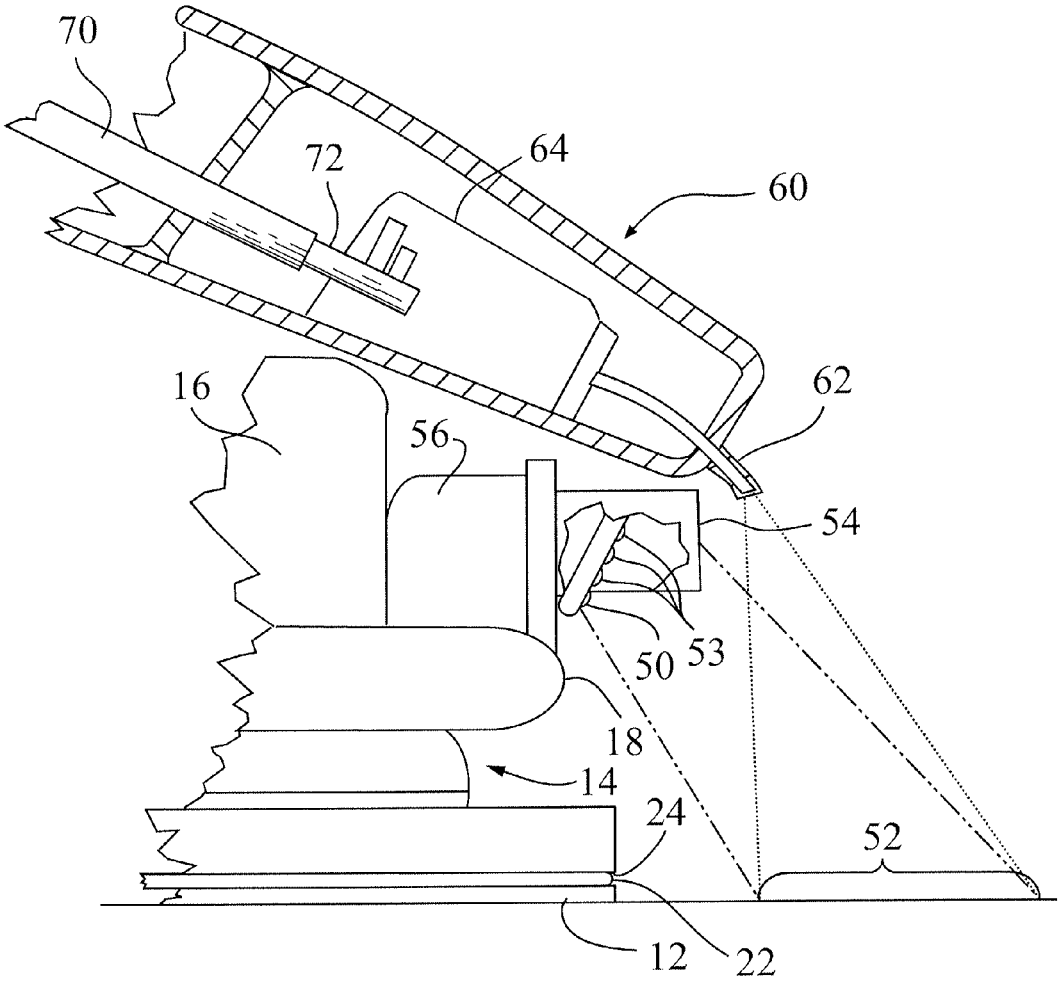
FIG. 4 is a partially broken away elevation view partially in cross section illustrating LED lighting and spraying of the floor area adjacent to the cleaning head.

Head 12 not only rotates, but also moves in an orbital fashion within housing 14 to provide a rotating and lateral or sideways moving action over the floor. In other words, the output rotating shaft of electric motor 16 not only provides rotary motion to head 12, but causes head 12 while rotating to orbitally move about the axis of the motor by structures known in the art. For example, see U.S. Pat. No. 5,355,542 issued Oct. 18, 1994. However, many of these machines are built of such size and weight that they are not suitable for use in the intended invention. One presently preferred orbital cleaning and buffing machine which may be suitable for use is one made by Ryobi and sold as its Model No. RB101 ten inch orbital buffer which is commercially available. This is sold as a hand held orbital buffer, but its structure or similar structure may be adapted for use in the residential wood floor cleaning machine of the present invention. Housing 14 is provided with a ring 18 on the periphery of housing 14. Preferably head 12 has a diameter in the range of 8 to 10 inches. However any suitable orbital buffing or polishing machine may be used for the motor and orbital rotation mechanism within the scope of the present invention The actual cleaning of the floor is done by a cleaning cloth such as a terry cloth or other towel like material, preferably of cotton, which is attached to orbital head 12. Terry cloth 12 may be new or old towel material or it may be terry cloth cut or woven to a shape to compliment the head 12. Various means may be utilized to attach the terry cloth to head 12. These include as illustrated in FIG. 1 a terry cloth 20 being placed over the bottom of head 12 and up over its periphery and retained in position by a rubber band 22. The terry cloth 20 in FIG. 1 is broken away to show head 12 and rubber band 22. Preferably, rubber band 22 would be over the terry cloth 20 and over a groove 24 formed in the periphery of head 12 at the location of rubber band 22 as best seen in FIGS. 1 and 4. Other materials may be utilized other than terry cloth 20 for providing the cleaning friction to the floor, but preferably at present, by way of example and not by way of limitation, a cotton terry type material may be preferred.

Figure 2:
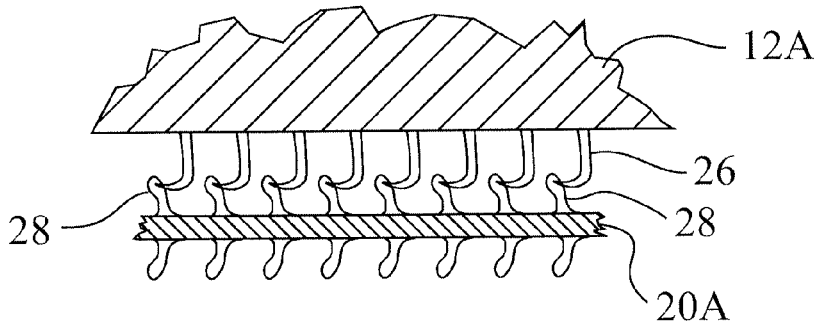
FIG. 2 is a partially broken away cross sectional view of a cleaning head which has attached to it a terry cloth by means of hook type cloth fasteners.

An alternative means of attaching a terry cloth 20 to head 12 is as illustrated in FIG. 2 wherein hooks 26 of a cloth fastener, commercially available under the trademark "VELCRO", are mounted to the bottom of an orbital head 12A. Hooks 26 engage loops 28 on terry cloth 20A. Other equivalent means may be utilized for attaching a cleaning cloth or terry cloth to head 12 or 12A.

Cleaning machine 10 is provided with a handle 30 mounted to a bracket 40. Bracket 40 may be pivotally mounted to housing 12 and contained within the diameter of housing 12. In a presently preferred embodiment as illustrated in FIG. 1, bracket 40 is preferably mounted to the inside surface of ring 18 by a pivot pin or other suitable pivotable fastener 42.

Bracket 40 includes a stop 44 for preventing handle 30 and bracket 40 from pivoting more than about 90 degrees. In other words, if handle 30 were continued to be raised, stop 44 would eventually hit the upper surface of ring 18 preventing further pivoting of handle 30 and bracket 40.

As best illustrated in FIGS. 1 and 4, at least one LED light 50 is mounted to direct LED light to illuminate a portion 52 of the floor area adjacent to head 12. As best illustrated in FIGS. 1 and 4, preferably there are four LED lights which provide intense illumination of floor area 52. The other three LED lights are designated by the numeral 53. However, LED lights herein include by definition other types of high intensity lights which may use more or less than four. The LED lights 50, 53 are provided with a shield 54 and are mounted on an electrical box 56 which may be mounted to an upper portion of ring 18 of housing 14. It is understood that more or less than four LED lights may be utilized to illuminate the desired portion of 52 of the wood floor area 11.

A sprayer 60 is provided to provide a wood cleaning solution via spray head 62 to the same portion 52 of wood floor area 11.

The spray solution may be any suitable solution which provides beneficial cleaning action for the cleaning of wood floors. A presently preferred wood floor cleaning solution is commercially available at various retail locations and is distributed by BonaKemi USA, Inc. under the trademark BONA having an address of 2550 S. Parker Road, Suite 600, Aurora, Colo. 80014. However, it is understood that various other wood floor cleaning solutions may be utilized in practicing the present invention.

Sprayer 60 may be mounted to a tubular structure 70 mounted to handle 30. The sprayer 60 is mounted to a lower portion of tubular structure 70 for controllably spraying a controlled amount of liquid on the floor area illuminated by the at least one LED light 50 or the four lights 50, 53. Sprayer 60 includes a mechanical pump 64. This may be similar to mechanical pumps found in spray bottles and other spray dispensers which are not electrically or power operated. It is desired to keep the spray minimal and controllable for effective and efficient cleaning without flooding the floor. Sprayer 60 mounted at the lower end of tubular structure 70 is mechanically operated by a first lever 80 mounted on an upper portion of handle 30. The operation of sprayer 60 by the operation of first lever 80 is mechanically connected to sprayer 60 by a mechanical connection mounted in either tubular structure 70 or handle 30. Preferably, in accordance with the present invention, the mechanical connection or mechanical transmission of motion from first lever 80 to mechanical pump 64 in sprayer 60 is by means of a tube or transmission rod 72 mounted within tubular structure 70 as illustrated in FIGS. 1 and 4.

As best illustrated in FIG. 1, sprayer 60 has a removable reservoir 74 for ease in refilling sprayer 60 with a suitable floor cleaning solution as described above.

In a presently preferred embodiment, tubular structure 70 would be mounted to handle 30 by a plurality of interconnecting elements forming a truss like structure of two legs, namely 30 and 70. The plurality of elements may be arranged in various forms. One or two interconnecting elements may be utilized. However, as presently preferred in FIG. 1, a truss like structure comprised of elements 32 perpendicular to handle 30 and substantially perpendicular to tubular structure 70 are provided. Additional elements 34 may be provide between handle 30 and tubular structure 70 at an acute angle substantially as illustrated in FIG. 1. This provides a truss like structure which increases strength and reduces the overall weight by requiring less structural thickness of material in handle 30 and tubular structure 70.

Accordingly, a fairly rigid structure of light weight may be provided which includes a handle structure 30 and a tubular operating structure 70 which mounts sprayer 60 above the LED lights, spaced away from the lights such that the sprayer may move freely over the lights and provide the spray to floor area 52. Further, tubular structure 70 provides a mechanical operating connection between lever 80 and mechanical pump 64 in sprayer 60.

Electrical power is provided to cleaning machine 10 via electric power cord 58. Power cord 58 may be stored by wrapping it around cord hooks 36 and 38 mounted on handle 30. Electrical power is provided via power cord 58 to electrical box 66 which supplies power via on/off switch 82 to LED lights 50, 53 via lines 98 and to an operating switch 92. The squeezing of second lever 90 closes switch 92 and applies power to electric motor 16 via lines 96.

The power is applied to both the light emitting diodes and the motor when the motor is operating, thereby requiring the light emitting diodes to always be on when the motor is running. Release of second lever 90 removes power from the electric motor 16 but light emitting diodes 50, 53 remain energized as long as the on/off switch 82 is on.

Figure 3:
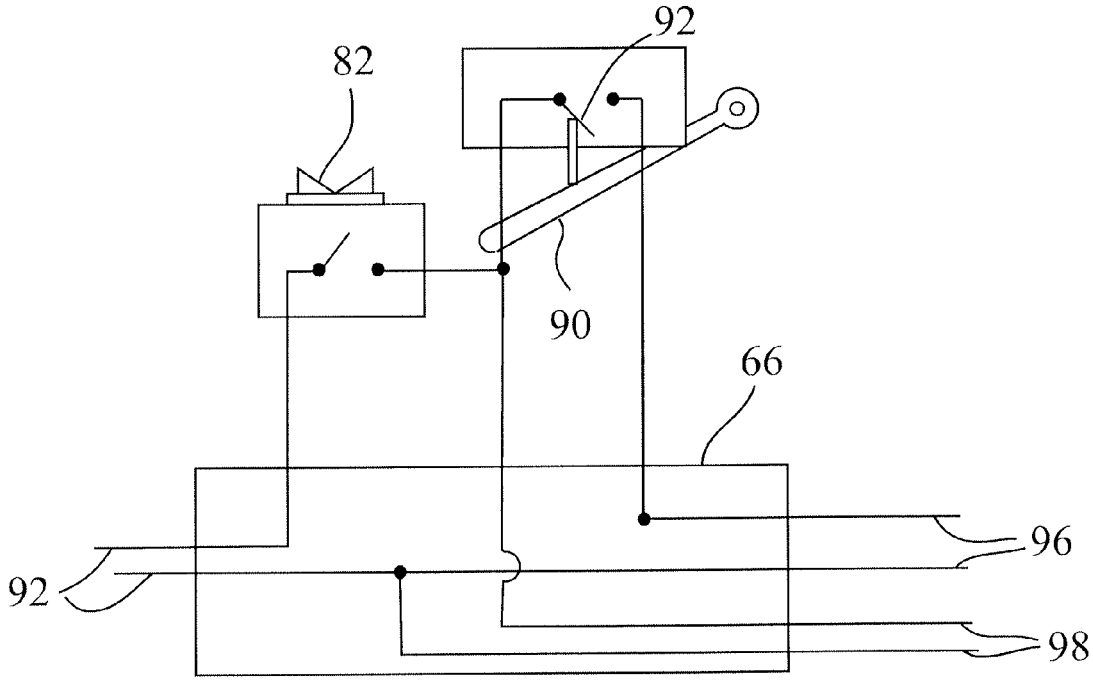
FIG. 3 is a schematic diagram illustrating an on/off switch and a switch for operating simultaneously the lights and the motor.

The circuitry is best illustrated in FIG. 3. Electrical power is provided via lines 92 through on/off switch 82 to light emitting diodes 50, 53 via lines 98 and to operating switch 92. Operating switch 92, when closed, applies power to operate motor 16 via lines 96. Accordingly, the light emitting diodes are on whenever power switch 82 is on. The motor is controlled by switch 92 turning on motor 16 by applying power to lines 96 to motor 16 when lever 90 is squeezed or compressed. Light emitting diodes 50, 53 are always illuminated when power switch 82 is on, including times when motor 16 is on or off. Accordingly, the light emitting diodes illuminate the area to be cleaned before operation of the motor, including times when the floor is initially examined, during times when it is being sprayed, during operation of the motor during cleaning and to inspect the floor after the cleaning is completed.

Preferably, as illustrated, levers 80 and 90 are mounted on an upper portion of handle 30, near hand grips 100 and 102, respectively.

The present invention may be embodied in other specific forms without departing from the spirit or essential attributes thereof and, accordingly, reference should be made to the appended claims, rather than to the foregoing specification as indicating the scope of the invention.

We claim:

1. Apparatus comprising:

an orbital circular cleaning head mounted in a circular housing and driven by an electric motor;

means for attaching a cleaning cloth to said head;

said means for attaching said cleaning cloth to said head is comprised of a rubber band mounted over said cleaning cloth over a groove in a periphery of said head;

a handle mounted to a bracket, said bracket being pivotally mounted to said housing and contained within the diameter of said housing;

said bracket including a stop for preventing said handle and bracket from pivoting more than about 90 degrees;

at least one LED light mounted to direct LED light to illuminate a portion of floor area adjacent to said head;

a tubular structure mounted to said handle;

a sprayer mounted to a lower portion of said tubular structure for controllable spraying a controlled amount of liquid on the floor area illuminated by at least one LED light;

a mechanical operating means mounted within said tubular structure, said mechanical operating means being operable by a first lever mounted on an upper portion of said handle;

said sprayer including a mechanical pump mechanically operable to controllably spray in response to said mechanical operating means being operated by said first lever;

said sprayer having a removable reservoir and electrical controls, said electrical controls including an on/off switch mounted on an upper portion of said handle for supplying power to said at least one LED light and to an operating switch, and a second lever for operating said operating switch to turn on and off electrical power to operate said electrical motor.

2. Apparatus in accordance with claim 1 wherein said cleaning cloth is a terry cloth and said means for attaching said cleaning cloth to said head is further comprised of hook type cloth fasteners mounted on the bottom of said head which engage loops of said terry cloth.

3. An apparatus in accordance with claim 1 which includes four LED lights mounted in a cluster to illuminate a portion of the floor area adjacent to said head.

4. Apparatus in accordance with claim 1 wherein said bracket is pivotally mounted to a ring of said housing on the periphery of said housing.

5. Apparatus in accordance with claim 1 wherein said cleaning cloth is a terry cloth.

6. Apparatus, comprising:

an orbital circular cleaning head mounted in a circular housing and driven by an electric motor;

means for attaching a terry cloth to said head;

a handle mounted to a bracket which is pivotally mounted to said housing contained within a diameter of said housing;

said bracket including a stop preventing said handle and said bracket from pivoting more than about 90 degrees;

said housing being provided with at least one LED light mounted on said housing with said at least one LED light directed to illuminate a portion of the floor area adjacent to said head;

a tubular structure mounted to said handle being interconnected by a plurality of elements forming a truss like structure of two legs;

a sprayer for controllably spraying a controlled amount of liquid on the floor area illuminated by said at least one LED light;

said sprayer being operated by a first lever mounted on an upper portion of said handle mechanically connected to said sprayer by a mechanical connection mounted within one of said legs of said truss like structure;

said first lever handle is operable to mechanically operate a mechanical pump in said sprayer to provide a controllable spray of liquid onto said floor area adjacent said head;

said sprayer having a removable reservoir; and electrical controls, said electrical controls including an on/off switch mounted on an upper portion of said handle for supplying power to said at least one LED light and to an operating switch, and a second lever for operating said operating switch which applies electrical power to operate said electrical motor.

7. Apparatus in accordance with claim 6 wherein said means for attaching said terry cloth to said head is comprised of a rubber band mounted over said terry cloth over a groove in a periphery of said head.

8. Apparatus in accordance with claim 6 wherein said means for attaching said terry cloth to said head is comprised of hook type cloth fasteners mounted on the bottom of said head which engage loops of said terry cloth.

9. An apparatus in accordance with claim 6 which includes four LED lights mounted in a cluster to illuminate a portion of the floor area adjacent to said head.

10. Apparatus in accordance with claim 6 wherein said bracket is pivotally mounted to a ring of said housing on the periphery of said housing.

11. Apparatus in accordance with claim 6 wherein said mechanical connection is a rigid tube mounted within said tubular structure.

* * * * *